US010369821B2

(12) United States Patent
Pérez Muñoz et al.

(10) Patent No.: US 10,369,821 B2
(45) Date of Patent: Aug. 6, 2019

(54) WEB MEDIUM ORIENTATION DETECTION

(71) Applicant: Océ Holding B.V., Venlo (NL)

(72) Inventors: Juan C. Pérez Muñoz, Venlo (NL); Lodewijk T. Holtman, Venlo (NL); Wilhelmus J. E. G. Verhofstad, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 314 days.

(21) Appl. No.: 15/598,871

(22) Filed: May 18, 2017

(65) Prior Publication Data

US 2017/0344842 A1 Nov. 30, 2017

(30) Foreign Application Priority Data

May 24, 2016 (EP) ..... 16171054

(51) Int. Cl.
*B41J 15/04* (2006.01)
*B65H 23/02* (2006.01)
(Continued)

(52) U.S. Cl.
CPC ..... *B41J 15/046* (2013.01); *B41J 15/16* (2013.01); *B65H 23/0204* (2013.01);
(Continued)

(58) Field of Classification Search
CPC ..... B41J 15/046; B41J 15/16; B65H 23/0204; B65H 23/035; B65H 2601/272; B65H 23/16; B65H 2511/242; B65H 2301/331
See application file for complete search history.

(56) References Cited

U.S. PATENT DOCUMENTS 745,240 A 11/1903 Rolland, Jr.
5,397,043 A 3/1995 Blanding
(Continued)

FOREIGN PATENT DOCUMENTS

EP 2 053 003 A2 4/2009
GB 1 107 927 3/1968

OTHER PUBLICATIONS

European Patent Office Search Reports issued in European Patent Application No. 16171054.6 completed Nov. 3, 2016, Nov. 14, 2016, and Apr. 4, 2014.
(Continued)

*Primary Examiner* — Julian D Huffman
(74) *Attorney, Agent, or Firm* — Birch, Stewart, Kolasch & Birch, LLP

(57) ABSTRACT

In a method for high speed printing of web-based media, a medium is pulled along a media transport path to a pulling transport mechanism. The orientation of the medium with respect to the media transport path is sensed and this orientation is compared to a reference orientation to detect an orientation error. If an orientation error is detected, one or more of the following steps is performed: adjusting a print job for an image to be printed on the web medium; adjusting the transport speed; emitting a communication signal; and stopping the pulling transport mechanism and the image forming unit. It is the insight of the inventor that productivity may be increased by allowing a "tight winding" printing system to start printing at relatively high speed and reduce this speed only when significantly large deviations in the orientation of the web are detected.

15 Claims, 4 Drawing Sheets

(51) Int. Cl.

| | |
|---|---|
| ***B41J 15/16*** | (2006.01) |
| ***B65H 23/035*** | (2006.01) |
| ***B65H 23/16*** | (2006.01) |

(52) U.S. Cl.

CPC ..... *B65H 23/035* (2013.01); *B65H 23/16* (2013.01); *B65H 2301/331* (2013.01); *B65H 2511/242* (2013.01); *B65H 2601/272* (2013.01); *B65H 2801/36* (2013.01)

(56) References Cited

U.S. PATENT DOCUMENTS

| | | | | |
|---|---|---|---|---|
| 5,791,541 | A | 8/1998 | Jitsuishi et al. | |
| 9,834,399 | B1 * | 12/2017 | Hashimoto | B26D 1/015 |
| 2011/0211031 | A1 | 9/2011 | Satoh et al. | |
| 2013/0008294 | A1 * | 1/2013 | Taguchi | G03G 15/6582 83/368 |
| 2014/0146102 | A1 | 5/2014 | Mizes et al. | |
| 2015/0009262 | A1 | 1/2015 | Bell et al. | |
| 2016/0136977 | A1 | 5/2016 | Sasaki et al. | |
| 2016/0159598 | A1 * | 6/2016 | Yamane | B65H 9/002 271/227 |

OTHER PUBLICATIONS

European Search Report for EP 17 17 1534, dated Oct. 4, 2017; pp. 1-2.

* cited by examiner

Fig. 1A
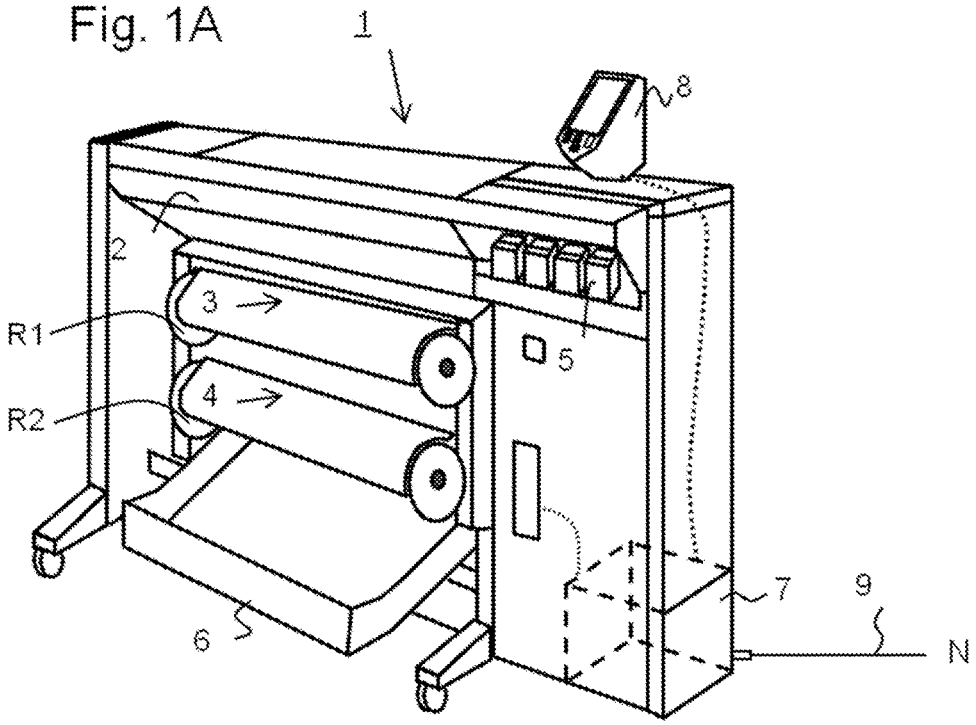
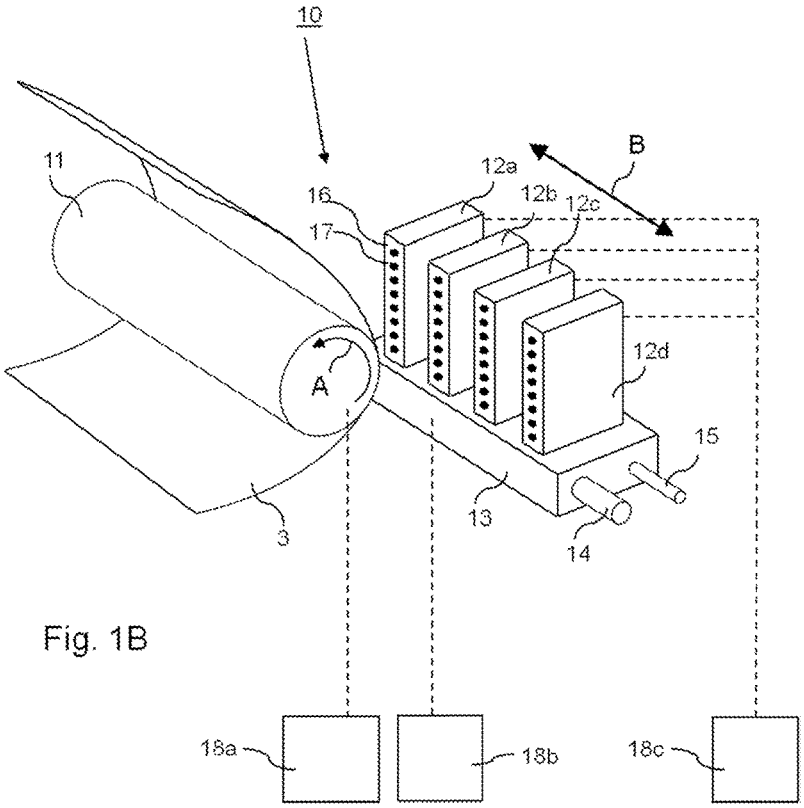
Fig. 1B

WEB MEDIUM ORIENTATION DETECTION

BACKGROUND OF THE INVENTION

1. Field of the Invention

The present invention relates to a method for high speed printing of web-based media, as well as to a printing system.

2. Description of Background Art

Web-based media are provided on media rolls and printed by spooling the web from a take-out roller via one or more print heads to a take-up roller. The take-up roller pulls on the web. For most media types a buffer zone ("blouse") is provided upstream of the take-up roller. In the buffer zone the web hangs slack, which prevents forces from the take-up roller to act on the web below the print heads. This is referred to as "loose winding". However, certain media types, such as very thin media, do not allow for "loose winding". These media must be pulled while under tension (so called "tight winding") and no buffer zone can be applied. In general the web is not perfectly aligned on the take-up roller. While pulling, the take-up roller then further exerts a lateral force on the web. This causes the web to move sideways below the print head, resulting in a lateral shift as well as a rotation of the printed image on the web. The web may even begin to laterally oscillate, continually moving from one side of the transport path to the other. Sufficiently large shifts or oscillations can cause paper jams.

In practice, there are generally two types of systems known for printing "tight winding" web media. In the first type, the transport speed of the web while "tight winding" is significantly reduced with respect to "loose winding" or the printing system's normal print speed. At this reduced speed the chance of the above mentioned lateral and rotational shifting of the web occurring is drastically reduced. A drawback of this reduced speed is that the print productivity is greatly reduced. A further drawback is that the operator himself is required to monitor the printing system for the occurrence of such deviations, thereby occupying the operator for the entire print job. Another type of systems allows for unattended printing by providing sensors for detecting the lateral and rotational shifting of the web. One or more correction mechanisms are provided to adjust and correct the position of the web based on input from the sensors. A drawback of these systems with correction mechanisms is that they are relatively complex and expensive. In general the media requiring "tight winding" comprise a relatively small portion of the media printed in graphics arts (10% or less). Therefore, the additional costs for providing a printing system with said sensors and corrections mechanisms are often considered too high and the operator opts for reduced speeds and "manual" monitoring of the print job.

It is known to provide side edge detection sensors along the transport path to detect the lateral position of the edges of the web medium, e.g. from US 2016/136977 A1, US 2014/146102 A1, and US 2015/009262 A1. A drawback of such side edge detection systems is their limited accuracy. For example, the web may be rotated over a large angle, while the side edge detection sensors detect only a small lateral deviation. This occurs when the rotation axis around which the web medium is rotated is longitudinally positioned near the sensors. Further, the side edge detection sensors allow for correction only after a substantial deviation was detected. It is difficult to determine the exact rotational behavior of the web medium from the side positions, making it hard to timely make a proper corrective action.

SUMMARY OF THE INVENTION

It is an object of the invention to provide a high productivity web printing system which allows for an accurate determination of the deviation of the web medium.

In accordance with the present invention, a printing system according to claim 1 and a method according to claim 10 and are provided.

In a first aspect, the present invention provides a printing system for printing web media, comprising:

- a take-out roller;
- a take-up roller for pulling a web medium along a media transport path from the take-out roller to the take-up roller;
- an image forming unit positioned along the media transport path,
- an orientation sensor for sensing an orientation of the web medium, the orientation sensor comprising:
  - a curved medium support surface defining a turn in the media transport path, which curved medium support surface is tiltable around a tilting axis, which tilting axis extends in a transport direction substantially tangential to the curved medium support surface in a reference orientation;
  - a tilting sensor for determining tilting data proportional to a tilting angle by which the curved medium support surface is tilted from its reference orientation around the tilting axis;
- a controller configured to:
  - receive the tilting data from the orientation sensor;
  - compare the tilting data to the reference orientation to determine an orientation error;
  - compare the orientation error to a deviation threshold.

When the controller determines a "tight winding" mode is applied, the controller is configured to control the pulling transport mechanism to start pulling the web at a predefined speed. Variations in tension can cause the medium to begin to "wander" in the lateral direction. The lateral motion of the web may be periodic with increasing amplitude. Thereby, the medium can laterally run outside of the transport path, resulting in a paper jam. The curved medium support surface allows for the detection of these variations in tension before or at the initial stage of the lateral deviation of the web medium. This allows the deviation to be detected in an early stage, allowing for a timely correction. By sensing the tilting of the curved medium support surface, the difference in tension can be sensed more directly then by e.g. the detection of the lateral position of the web medium. By sensing the tilting of the curved medium support surface, the changes in tension can be detected independent of and even before the lateral deviation of the web medium. The tilting thus provides a relatively direct indication of the tension forces affecting the rotational and lateral shifting of the web medium.

It is the insight of the inventors that by detecting the tilting of a curved medium support surface in the media transport path around a tilting axis, which tilting axis extends in a transport direction substantially tangential to the curved medium support surface in a reference orientation, the rotational and lateral shifting behavior of the web medium may be accurately derived from said tilting. Thereby, the object of the present invention has been achieved.

More specific optional features of the invention are indicated in the dependent claims.

In one example of the present invention, the orientation of the medium, being the lateral position and/or a rotation angle of the web, is derived from the tilting data generated by the orientation sensor. The tilting of the curved medium support surface is continuously sensed during operation by e.g. detecting the tilting angle of the curved medium support surface. The tilting angle provides an indication for the orientation of the web medium. The controller then derives the lateral position and/or an rotation angle of the web medium from the tilting angle (in another embodiment the tilting angle itself is used for comparison to the threshold). The controller comprises a processor for receiving the orientation data and comparing it to a reference orientation. This reference is an orientation wherein the web is aligned with the transport path. Since not all orientations deviations need be corrected the processor compares the data first to deviation threshold. Deviations or mis-orientations below said threshold are not corrected, leading to the printing system maintaining its present operating status and continued monitoring of the web's orientation. When the data exceeds the threshold, the processor proceeds to classify the deviation. Such a significantly large deviation between the sensed orientation of the web and the reference orientation is expressed as the orientation error, for example a value for a lateral displacement or a rotation angle. Depending on the size or severity of the orientation error, the controller emits a control signal to a respective component of the printing system to perform one or more corrective actions. Therein, the controller may control the image forming unit to reposition itself or to adjust the bitmap of the to be printed image. The pulling transport mechanism may be controlled to reduce or increase the print speed to bring the system to a known stable configuration, wherein oscillations are absent. The controller may control a communication unit to inform an operator via a communication or error signal. Further, the controller may control the printing system to stop the print job. The presence of the operator while printing is initially not required, since the controller will initiate the corrective action upon detection of a deviation. This increases productivity as the operator may manage multiple printing systems in parallel. Productivity is further increased as the overall output is increased, since all tight winding print jobs are performed at high speeds, at least until detection of a substantial deviation in the orientation of the web. The printing system according to the present invention is relatively cheap and easy to implement, since no complex correction mechanisms for repositioning the web are required.

In an embodiment, the curved medium support surface comprises a curved buffer plate configured to turn the web medium over a predefined turn angle, which may be any non-zero angle, but is preferably around 60 to 120°, very preferably 90°. The curved buffer plate is tiltable around the tilting axis. When titling around the tilting axis, one lateral side of the curved buffer plate is raised above the reference orientation, while the other lateral side is lowered below the reference orientation. The tilting thus affects a motion of one lateral side of the curved buffer plate in a direction perpendicular to the plane of the curved buffer plate while the other lateral side of the buffer plate moves in an opposite direction perpendicular to the plane of the curved buffer plate. Basically, the height of the different sides of the buffer plate with respect to the transport path in the reference orientation varies during operation. Preferably, the tilting axis and the above mentioned directions are defined with respect to a central or middle portion of the buffer plate, as seen in the transport direction. Said central portion is positioned on the buffer plate, for example, angularly halfway the turn angle provided by the curved buffer plate in the transport path. The titling axis is substantially parallel to the transport velocity vector of the web medium over said central portion with the buffer plate in the reference orientation.

In an embodiment, the tilting sensor comprises a displacement sensor, such as a linear position sensor, attached to the curved medium support surface for detecting a displacement of a section, for example a lateral side section, of the curved medium support surface in a direction substantially perpendicular to the curved medium support surface. The controller is then configured to compare the detected displacement to a the reference orientation or a reference displacement to determine the tilting data. The tilting of the curved medium support surface can be detected by determining the out-of-plane orientation of the buffer plate. The displacement sensor, for example a linear encoder or optical distance sensor, detects the amount by which a section of the buffer plate is displaced from its reference position. The titling angle can then be derived by basic geometry.

In another embodiment, the tilting sensor comprises a pair of displacement sensors attached to opposing lateral sides of the curved medium support surface, each displacement sensor configured for detecting a displacement of a respective side of the curved medium support surface in a direction substantially perpendicular to the curved medium support surface. The tilting sensor thus comprises a 'left' and 'right' side displacement sensor. The controller is configured to compare the detected displacements to one another to determine the tilting data. By providing displacement sensors at the laterally opposing ends of the buffer plate, the orientation of the buffer plate may be accurately detected. The curved medium support surface is substantially straight, even or flat in the lateral direction. The displacement sensors then detect the respective height of two laterally spaced apart points on the curved medium support surface. Thereby, the orientation of the buffer plate can be determined with great accuracy, from which the titling can be determining with high accuracy. A further advantage is that the displacement sensors are positioned out of the way of the web medium and provide no risk of coming into contact with the printed image.

In a preferred embodiment, the curved medium support surface is positioned upstream of the image forming unit. Thereby, the deviation of the web medium may be detected upstream of the where the image is to be printed, allowing time and space for corrective action. The curved medium support surface may for example be positioned upstream of the print surface whereupon the web medium is supported during printing. Preferably, the curved medium support surface is configured to turn the web medium parallel to the print surface.

In a preferred embodiment, if the orientation error exceeds the deviation threshold, the controller is configured to emit an error signal for initiating an appropriate action of the printing system. Thereby, the printing system may run without continuous attendance by an operator. Preferably, the error signal is configured for reducing the transport speed of the web medium on the transport path. By reducing the transport velocity or speed to a lower speed, the periodic wandering of the web medium may be reduced while production still continues. The speed may be reduced even to zero for stopping the transport to prevent damage to the printing system or medium. Additionally or alternatively, the error signal may be configured for initiating at least one of the following:

controlling the image forming unit to adjust a print job for an image to be printed on the web medium; and emitting a communication signal prompt to an operator.

The print job may be adjusted in to correct for the rotation of the web medium with respect to the image forming unit. This is advantageous for small deviations. The controller may also inform the operator of the occurrence of a deviation in the web medium's position, such that the operator may assess the situation and take the appropriate action. This allows for unattended printing of the printing system according to the present invention.

In another embodiment, the controller is arranged for:

classifying the orientation error into an error level by comparing the orientation error to an error level reference; and selecting one of the following steps determined by the error level:

controlling the image forming unit to adjust a print job for an image to be printed on the web medium;

controlling the pulling transport mechanism to adjust the transport speed;

emitting an communication signal for prompting an operator; and controlling the image forming unit and the pulling transport mechanism to stop the image forming unit and the pulling transport mechanism.

The orientation error, for example its size or value, determines the error level. The controller may comprise a memory unit storing a plurality or error levels, along with corresponding thresholds or ranges defining each error level. When an orientation error is determined to fall in the range of a specific error level, said error level is selected. The memory stores instructions for performing a set of actions or steps for each error level. The selected error level thus determines which corrective action is performed. This allows the controller to respond properly to different situations. Thereto, in a further embodiment, the error level reference comprises:

a first classification criterion to classify an orientation error as a first error level;

a second classification criterion to classify an orientation error as a second error level;

a third classification criterion to classify an orientation error as a third error level; and a fourth classification criterion to classify an orientation error as a fourth error level; and the controller further stores:

a first set of instructions for, when an orientation error is classified as the first error level, adjusting a print job for an image to be printed on the web medium;

a second set of instructions for, when an orientation error is classified as the second error level, adjusting the transport speed;

a third set of instructions for, when an orientation error is classified as the third error level, emitting a communication signal for informing an operator; and a fourth set of instructions for, when an orientation error is classified as the fourth error level, stopping the pulling transport mechanism and the image forming unit.

In another embodiment, the controller is arranged for determining a rotation angle parameter from the tilting data, which rotation angle parameter corresponds to an angle between a longitudinal direction of the web medium and a transport direction of the media transport path. In an even further embodiment, the orientation sensor further comprises an side edge displacement sensor arranged for sensing a position of a side edge of the web medium with respect to the media transport path. The side edge displacement sensor is arranged for sensing the lateral position shift of the web in the form of a displacement angle or distance between the web and the plane of the transport path. By further determining the position of the side edges, the orientation of the web may be determined with even higher accuracy.

In another embodiment, the printing system further comprises a buffer plate and urging elements for urging the buffer plate against the web medium, wherein the orientation sensor comprises a tilting angle sensor for determining a tilting angle between the buffer plate and a buffer plate reference orientation. The buffer plate reference orientation is defined by the initial or desired orientation of the web on the transport path, i.e. the ideal or non-deviated plane of the web as defined by the transport path. The tilting angle is measured around the tilting axis as the angle between a normal vector of the buffer plate and a normal vector of the plane of the transport path (which is preferably aligned with the normal vector of the buffer plate in the reference orientation). Any deviations in the web's orientation cause the web to pull on the buffer plate, which tilts the buffer plate. By sensing this tilting angle, the orientation of the web may be determined the sensed tilting angle. The out-of-plane allows for continuous and accurate tracking of the web's orientation.

In another embodiment the printing system further comprises a user interface for emitting a communication signal to inform the operator. The user interface may be provided with a communication device arranged for emitting a visual, sound, or wireless communication signal to the operator. The communication device is controlled by the controller and triggered to emit the communication signal when a predefined threshold for a deviation in the web's orientation has been exceeded. This allows for unattended printing.

In a further aspect, the present invention provides a method for printing of web-based media, the method comprising the steps of:

pulling a web medium at a predefined transport speed over a media transport path, which media transport path extends along an orientation sensor comprising a curved medium support surface defining a turn in the media transport path and along an image forming unit to a pulling transport mechanism;

sensing the tilting of the curved medium support surface around a tilting axis, which tilting axis extends in a transport direction substantially tangential to the curved medium support surface in a reference orientation;

comparing the sensed tilting to the reference orientation to determine an orientation error; and comparing the orientation error to a deviation threshold.

The operator inputs a print job to the printing system, setting the printing system for printing in a "tight winding" mode. The print job determines the initial print or transport speed when starting the print job to be relatively high, for example a normal or optimum transport speed which is preferably comparable to the printing speeds for loose winding so as to maintain a high level of productivity. A pulling transport mechanism, for example the take-up roller, initially pulls the web from the image forming unit at the predefined high speed. While printing, a tilting sensor senses the orientation of the curved medium support surface by determining its tilting around the tilting axis. A processor is provided to compare the sensed orientation of the curved medium support surface to its reference orientation. Said reference orientation is preferably the initial or desired orientation of the curved medium support surface during operation. Preferably, in the reference orientation the web is aligned in the transport direction. Any lateral unevenness in the tension on the web medium causes titling of the curved medium support surface, even before this tension significantly affects the lateral position of the web medium. The accuracy is improved over side edge position sensing, as the titling provides a more direct or proportional quantity for determining web tension. Thereby, the object of the present invention is achieved.

In another embodiment, the method according to the present invention further comprises the step of:

- sensing a displacement of a section of the curved medium support surface in a direction substantially perpendicular to the curved medium support surface; and
- determining the tilting of the curved medium support surface around a tilting axis from said displacement. The displacement provides an easy, cheap, and direct measure for to determine the tilting of the curved medium support surface. Preferably, the method according to the present invention further comprises the step of:
- sensing a displacement of a two opposing lateral sides of the curved medium support surface in a direction substantially perpendicular to the curved medium support surface; and
- determining the tilting of the curved medium support surface around a tilting axis from said displacements. By determining the height displacement of the curved medium support surface at two laterally spaced apart positions on said surface, the tilting angle around the tilting axis may be accurately determined, providing an accurate and versatile method.

In a further embodiment, the method according to the present invention further comprises the step of emitting an error signal if the orientation error exceeds the deviation threshold, preferably by a controller. This allows for unattended printing of the printing system, as the controller may be configured to execute an appropriate action in correspondence to e.g. the value of the determined titling angle.

In an example of the present invention, first it is determined whether the tilting angle or therefrom derived orientation of the web exceeds a deviation threshold, being defined as a lower limit below which orientation deviations need not be corrected. For such negligible deviations in the web's orientation, no corrective action is required and the printing system continues printing in its present configuration while the sensor keeps monitoring the tilting of the curved medium support surface. Orientation errors above the deviation threshold require correcting to prevent them from reducing the print quality. When such a significant orientation is detected, the processor proceeds to determine the severity of the deviation. The processor transmits a signal to a controller for starting a corrective action in correspondence with the determined severity of the deviation. For small deviations, the processor may instruct a controller to adjust or reposition the digital image or bitmap of the image to be printed on the web, such that the image is properly positioned on the web. When relatively large deviations between the sensed orientation of the web and the reference orientation are detected, the processor may instruct the controller to adjust the transport speed to reduce or eliminate the oscillations in the position of the web. The controller may further emit an auditive, visual or wireless error signal or communication signal, which informs an operator of the deviated orientation of the web. Further, in case of dangerously large deviations the controller may stop the printing system to effectively halt the print job to prevent damage to the web.

It is the insight of the inventor that productivity may be increased by allowing a "tight winding" printing system to start printing at relatively high speed and reduce this speed only when significantly large deviations in the orientation of the web are detected. Thereby the average print speed is increased along with the overall productivity. The present invention further allows for unattended printing, freeing up the operator and thereby further increasing productivity, since the system is arranged to take corrective action or to inform the operator when deviations are detected. A sensor for determining the orientation of the web may be relatively easily and cheaply implemented in the form of a buffer plate with a tilting detector. Without implementing expensive and complex correction mechanisms, the present invention allows for high speed printing while using "tight winding", resulting in high productivity without increasing the costs of the printing system. Thereby the object of the present invention has been achieved.

In an embodiment, the method according to the present invention further comprises at least one of the following steps, if the orientation error exceeds the deviation threshold:

- adjusting a print job for an image to be printed on the web medium;
- adjusting, specifically reducing, the transport speed;
- emitting a communication signal; and
- stopping transport of the web medium and/or printing by an image forming unit.

The controller initiates one or more of the above actions by transmitting the error signal to the respective modules of the printing systems and/or to the operator. Thus, in absence of an operator, the controller may thus start corrective action or inform the operator to tend to the printing system.

In an embodiment, the predetermined speed is a high speed, being at least equal to the normal print speed of the printing system, for example during loose winding. Thereby productivity is not substantially reduced when switching the printing system to the loose winding mode, maintaining an average high level of productivity.

In an embodiment, the orientation of the web may be defined by a lateral position of the web with respect to the transport path and/or by a rotation angle between a longitudinal direction of the web with respect to a transport direction of the transport path. Both the lateral position and the rotation angle may be easily and accurately determined from the titling generated by a tilting sensor according to the present invention.

In an even further embodiment, the step of sensing comprises deriving a lateral position or rotation of a side edge of the web medium with respect to the transport path from the tilting of the curved medium support surface. The tilting sensor generates tilting data. This tilting data is then transmitted by said sensor to a processor, which is arranged for deriving a lateral position and/or rotation of the web medium from the tilting data. These derived parameters may then be compared to the reference orientation. The reference orientation may for example be the initial lateral position of the web determined at the start of the print job and/or a lateral position of the web on the take-up roller. Lateral is here defined as a direction perpendicular to the transport direction of the transport path and parallel to a plane of the web on the transport path. By comparing the derived parameters to this reference, the processor may determine the lateral displacement of the web. The rotation of the web may further be sensed by lateral side edge displacement sensors to further improve the accuracy. The determined lateral displacement may provide a measure for the severity of the deviation of the web compared to its desired orientation, and may thus be easily used to determine the appropriate corrective action to be taken.

In another embodiment, the step of comparing the orientation data to a reference orientation further comprises determining a rotation angle parameter, which rotation angle parameter corresponds to an angle between a longitudinal or length direction of the web medium and a transport direction of the media transport path, preferably measured in the plane of the web medium or the transport path. This allows the processor to determine the rotation of the web medium with respect to the transport direction of the transport path. The rotation of the web can be determined from the lateral position of the web, but this has the disadvantage of being unable to detect a rotation of the web wherein the lateral position of the web's side edges do not change. It is preferred to sense or detect out-of-plane tilting of the buffer plate or the web with respect to the plane of the transport path (i.e. around a tilting axis parallel to the transport direction). Since the local tilting of the web on the buffer plate is determined by the tension in the web, the sensed tilting orientation provides an accurate measure for the tension in the web. Further, a value of the rotation angle of the web may be derived from the tilting angle. Advantageously, the rotation of the web may be determined regardless of the lateral position of the web. Out-of-plane is defined here as a direction perpendicular to the plane of the web (or a portion thereof). The out-of-plane direction is further preferably perpendicular to the lateral direction as well as the transport direction for each respective portion of the transport path and/or the web. It is within the scope of the present invention to directly apply the tilting data, tilting angle, or any parameters which may be derived there from, for the comparison step.

In a preferred embodiment the method according to the present invention, further comprises the step of a buffer plate being urged against the web medium, and wherein the step of sensing comprises determining a tilting angle parameter corresponding to an orientation of the buffer plate with respect to a buffer plate reference orientation. The moveable buffer plate may be pre-tensioned against the web by urging elements. The out-of-plane orientation of the buffer plate is determined to derive the displacement of the web. Since the out-of-plane orientation of the buffer plate is determined by the rotation of the web tensioned against the buffer plate, the tilting angle may be used as a measure for the rotation angle parameter to determine said rotation of the web. In a preferred embodiment, the buffer plate is provided with one or more displacement sensors positioned at the lateral edges of the buffer plate to determine the tilting angle. From the displacement signal of the at least one displacement sensor, the orientation of the buffer plate may be derived, which in turn allows the processor to determine the rotation of the web. The sensed displacement of the buffer plate provides an accurate determination of the tilt. The buffer plate reference orientation may be defined as the position of the buffer plate wherein the sum of the forces acting on the web is oriented parallel to the transport direction, i.e. in case of a perfectly aligned web wherein the net torque on the web (around the tilting axis or an out-of-plane axis) is zero. Preferably, the reference orientation of the buffer plate is defined as the plane of the buffer plate being parallel or aligned with the plane of the transport path. The transport path here is preferably the 'ideal' path and plane as defined by transport mechanism of the printing mechanism from which the web deviates under the influence of the lateral forces from its misalignment on the take-up roller.

In another embodiment, the buffer plate is provided upstream of the image forming unit. A further advantage is that the buffer plate may be provided upstream of the print head, allowing the web's orientation to be corrected before a sensed region of the web reaches the print heads.

In an embodiment, the step of comparing further comprises determining the orientation error. The orientation error is defined by a non-zero deviation between the orientation data, which represents the sensed orientation of the curved medium support surface on the buffer plate, and the reference orientation. The reference orientation corresponds to the desired orientation of the web when perfectly longitudinally aligned in the transport direction of the transport path as well as laterally aligned with the portion of the web attached to the take-up roller. The orientation error provides a clear indication of the deviation of the web from its desired position.

In a preferred embodiment, the method according to the present invention further comprises the steps of:

- if an orientation error is detected, determining the orientation error; and subsequently
- classifying the orientation error into an error level by comparing the orientation error to an error level reference;
- selecting one of the following steps determined by the error level:
  - adjusting a print job for an image to be printed on the web medium;
  - adjusting the transport speed;
  - emitting a communication signal; and
  - stopping the pulling transport mechanism and the image forming unit.

In the step of comparing the tilting data, the orientation error is determined, which provides a measure for the deviation between the sensed orientation of the web and the reference orientation of the web. The deviation may be expressed as a lateral position error in for example μm or mm, or as a angle error in for example ° or rad. In either example zero deviation or error corresponds to the reference orientation, such that in this case the web is properly aligned on the transport path. In the subsequent comparison step, the relative size of the orientation error is compared to an error level reference to classify the sensed deviation of the web. The determined error level determines the corrective action to be taken, for example adjusting the digital bitmap of the to be printed image in case of minor deviations. By determining the error level, the printing system is able to react appropriately to a wide variety of different situations.

In another embodiment, if the orientation error exceeds the deviation threshold, the step of classifying the orientation error is performed, and if the orientation error is below the deviation threshold, the step of comparing the orientation data to a reference orientation is repeated. Every sensed orientation is compared to the deviation threshold to determine whether a corrective action is required. Negligibly small deviations do not result in visible (at least not to the human eye) artifacts in the printed image and may thus be ignored. No action is then required and the printing system proceeds to print at the predetermined high speed. Deviations have a noticeable effect on the print quality should be corrected. These deviations are detected when it is determined that the orientation error exceeds the deviation threshold, which may be defined as an orientation angle threshold or lateral position shift. After determining that the error has exceeded the threshold, it is classified based on its severity, such that the printing system may perform the corrective action for the identified class of said error.

In a further embodiment, the error level is proportional to the tilting angle or to the rotation angle parameter. The rotation of the web determines the tilting of the buffer plate, which provides an accurate measure for the deviation of the web. Since the rotation of the web and the tilting angle are proportional, an orientation error can be easily classified based on its magnitude. Thereby, further parameters may be taken into account such as the temporal behavior of the deviation, e.g. its frequency and/or amplitude. A drastically increasing deviation requires a different corrective action than a slowly increasing one. The error levels are preferably different levels of severity of the deviation, such as minor deviations or severe deviations. Every error level is defined by a lower limit threshold, which when exceeded by the determined orientation error determines the orientation error to be of said error level. The corrective action is thereby proportional to the determined deviation.

In a further embodiment, the controller is further configured for, if the orientation error exceeds the deviation threshold, classifying the orientation error, and, if the orientation error is below the deviation threshold, repeated comparison of the orientation data to a reference orientation. This allows the controller to distinguish between orientation deviations which require corrective actions (e.g. deviations with visible effects) and negligible deviations which do not substantially affect print quality. By comparing the deviation angle or distance to a threshold value, the printing system performs no unnecessary corrective actions.

In another embodiment, the step of adjusting the print job comprises at least one of the following steps:

- adjusting a position where the image is to be positioned with respect to the transport path;
- adjusting a position of the image forming unit with respect to the transport path; and
- adjusting a number of swaths for forming the image on the web medium.

The position of the image on the web medium may be corrected for the determined deviation. This may be done by adjusting the bitmap to reposition the to be printed image into proper alignment with the web, thereby cancelling or counteracting the deviation of the web. In case of a moveable print head, the print head position may be adjusted, for example by the determined lateral offset of the web. The number of swaths or passes for printing the image may also be increased, resulting in more overlapping bands. This ensures a properly aligned image on the web.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein:

FIG. 1A is a schematic perspective view of a printing system according to the present invention;

FIG. 1B is a schematic perspective view of an inkjet printing assembly of the printing system in FIG. 1A;

DETAILED DESCRIPTION OF THE PREFERRED EMBODIMENTS

Figure 2:
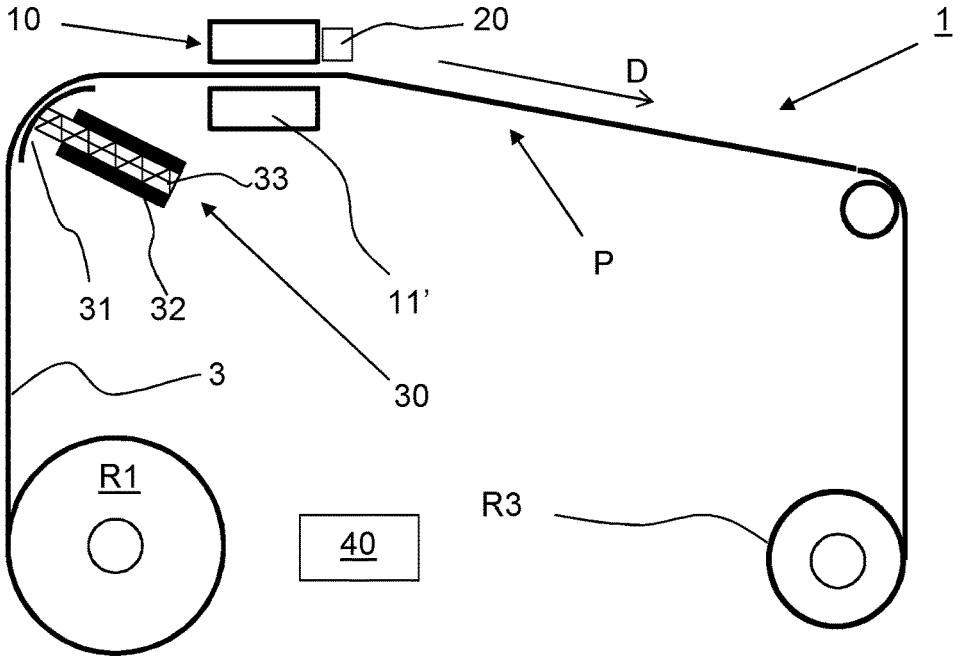
FIG. 2 is a schematic side view of a printing system according to the present invention.

The present invention will now be described with reference to the accompanying drawings, wherein the same reference numerals have been used to identify the same or similar elements throughout the several views.

FIG. 1A shows a printing system 1, wherein printing is achieved using a wide format inkjet printer. The wide-format printing system 1 comprises a housing 2, wherein the printing assembly, for example the ink jet printing assembly shown in FIG. 1B is placed. The printing system 1 also comprises a storage means for storing image receiving member 3, 4, a delivery station to collect the image receiving member 3, 4 after printing and storage means 5 for marking material. In FIG. 1A, the delivery station is embodied as a delivery tray 6. Optionally, the delivery station may comprise processing means for processing the image receiving member 3, 4 after printing, e.g. a folder or a puncher. The wide-format printing system 1 furthermore comprises means for receiving print jobs and optionally means for manipulating print jobs. These means may include a user interface unit 8 and/or a control unit 7, for example a computer.

Images are printed on an image receiving member, for example paper, supplied by a roll 3, 4. The roll 3 is supported on the roll support R1, while the roll 4 is supported on the roll support R2. Alternatively, cut sheet image receiving members may be used instead of rolls 3, 4 of image receiving member. Printed sheets of the image receiving member, cut off from the roll 3, 4, are deposited in the delivery tray 6.

Each one of the marking materials for use in the printing assembly are stored in four containers 5 arranged in fluid connection with the respective print heads for supplying marking material to said print heads.

The local user interface unit 8 is integrated to the print engine and may comprise a display unit and a control panel. Alternatively, the control panel may be integrated in the display unit, for example in the form of a touch-screen control panel. The local user interface unit 8 is connected to a control unit 7 placed inside the printing apparatus 1. The control unit 7, for example a computer, comprises a processor adapted to issue commands to the print engine, for example for controlling the print process. The printing system 1 may optionally be connected to a network N. The connection to the network N is diagrammatically shown in the form of a cable 9, but nevertheless, the connection could be wireless. The printing system 1 may receive printing jobs via the network. Further, optionally, the controller of the printer may be provided with a USB port, so printing jobs may be sent to the printer via this USB port.

FIG. 1B shows an ink jet printing assembly 10. The ink jet printing assembly 10 comprises supporting means for supporting an image receiving member 3. The supporting means 11 are shown in FIG. 1B as a platen 11, but alternatively, the supporting means 11 may be a flat surface. The platen 11, as depicted in FIG. 1B, is a rotatable drum 11, which is rotatable about its axis as indicated by arrow A. The supporting means 11 may be optionally provided with suction holes for holding the image receiving member 3 in a fixed position with respect to the supporting means 11. The ink jet printing assembly 10 comprises print heads 12*a*-12*d*, mounted on a scanning print carriage 13. The scanning print carriage 13 is guided by suitable guiding means 14, 15 to move in reciprocation in the main scanning direction B. Each print head 12*a*-12*d* comprises an orifice surface 16, which orifice surface 16 is provided with at least one orifice 17. The print heads 12*a*-12*d* are configured to eject droplets of marking material onto the image receiving member 3. The platen 11, the carriage 13 and the print heads 12*a*-12*d* are controlled by suitable controlling means 18*a*, 18*b* and 18*c*, respectively.

The image receiving member 3 may be a medium in web or in sheet form and may be composed of e.g. paper, cardboard, label stock, coated paper, plastic or textile. Alternatively, the image receiving member 3 may also be an intermediate member, endless or not. Examples of endless members, which may be moved cyclically, are a belt or a drum. The image receiving member 3 is moved in the sub-scanning direction A by the platen 11 along four print heads 12*a*-12*d* provided with a fluid marking material.

A scanning print carriage 13 carries the four print heads 12*a*-12*d* and may be moved in reciprocation in the main scanning direction B parallel to the platen 11, such as to enable scanning of the image receiving member 3 in the main scanning direction B. Only four print heads 12*a*-12*d* are depicted for demonstrating the invention. In practice an arbitrary number of print heads may be employed. In any case, at least one print head 12*a*-12*d* per color of marking material is placed on the scanning print carriage 13. For example, for a black-and-white printer, at least one print head 12*a*-12*d*, usually containing black marking material is present. Alternatively, a black-and-white printer may comprise a white marking material, which is to be applied on a black image-receiving member 3. For a full-color printer, containing multiple colors, at least one print head 12*a*-12*d* for each of the colors, usually black, cyan, magenta and yellow is present. Often, in a full-color printer, black marking material is used more frequently in comparison to differently colored marking material. Therefore, more print heads 12*a*-12*d* containing black marking material may be provided on the scanning print carriage 13 compared to print heads 12*a*-12*d* containing marking material in any of the other colors. Alternatively, the print head 12*a*-12*d* containing black marking material may be larger than any of the print heads 12*a*-12*d*, containing a differently colored marking material.

The carriage 13 is guided by guiding means 14, 15. These guiding means 14, 15 may be rods as depicted in FIG. 1B. The rods may be driven by suitable driving means (not shown). Alternatively, the carriage 13 may be guided by other guiding means, such as an arm being able to move the carriage 13. Another alternative is to move the image receiving material 3 in the main scanning direction B.

Each print head 12*a*-12*d* comprises an orifice surface 16 having at least one orifice 17, in fluid communication with a pressure chamber containing fluid marking material provided in the print head 12*a*-12*d*. On the orifice surface 16, a number of orifices 17 is arranged in a single linear array parallel to the sub-scanning direction A. Eight orifices 17 per print head 12*a*-12*d* are depicted in FIG. 1B, however obviously in a practical embodiment several hundreds of orifices 17 may be provided per print head 12*a*-12*d*, optionally arranged in multiple arrays. As depicted in FIG. 1B, the respective print heads 12*a*-12*d* are placed parallel to each other such that corresponding orifices 17 of the respective print heads 12*a*-12*d* are positioned in-line in the main scanning direction B. This means that a line of image dots in the main scanning direction B may be formed by selectively activating up to four orifices 17, each of them being part of a different print head 12*a*-12*d*. This parallel positioning of the print heads 12*a*-12*d* with corresponding in-line placement of the orifices 17 is advantageous to increase productivity and/or improve print quality. Alternatively multiple print heads 12*a*-12*d* may be placed on the print carriage adjacent to each other such that the orifices 17 of the respective print heads 12*a*-12*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 17.

Upon ejection of the marking material, some marking material may be spilled and stay on the orifice surface 16 of the print head 12*a*-12*d*. The ink present on the orifice surface 16, may negatively influence the ejection of droplets and the placement of these droplets on the image receiving member 3. Therefore, it may be advantageous to remove excess of ink from the orifice surface 16. The excess of ink may be removed for example by wiping with a wiper and/or by application of a suitable anti-wetting property of the surface, e.g. provided by a coating.

FIG. 2 shows a schematic side view of a printing system 1 according to the present invention. A web medium 3 is provided from a medium roll R1 supported on a take-out roller which may be provided with an actuator for rotating the roll R1. From the media roll R1, the transport path P extends via a moveable buffer plate 30 to the inkjet printing assembly 10, where the web 3 is supported by the platen 11' or print surface 11'. The curved buffer plate 31 is tiltable around the titling axis TA, which extends tangentially to top surface of the buffer plate 31 in the transport direction D. On the carriage 13 of the inkjet printing assembly an optical sensor 20 is mounted, which sensor is arranged for sensing the web to determine the print quality or the web's position. Downstream of the print surface 11', the transport path P extends further to the pulling transport mechanism R3, which in FIG. 2 is a take-up roller R3. The roller R3 comprises an actuator for driving the take-up roller R3. A controller 40 is provided for receiving the print job and controlling the printing system 1 accordingly.

The web medium 3 provided from the roll R1 has a low plane stiffness, which causes the web 3 to buckle easily. Examples of such media are thin media, textile, or certain types of banner media. When sliding over the print surface 11', the web 3 experiences a friction force which causes the web 3 to buckle, even though a suction force is applied via vacuum holes in the print surface 11' to hold the medium 3 against the print surface 11'. The buckled web 3 may come into contact with the print heads 12*a*-*d*, resulting in the smearing of ink across the web 3 or damage to the print heads 12*a-d*. To prevent buckling, the medium 3 requires a pulling force to flatten the web 3 over the print surface 11'. This pulling force or tension is provided by a pulling transport mechanism R3 downstream of the inkjet printing assembly 10. Said pulling transport mechanism R3 may be a transport pinch along the transport path P, but is preferably formed as a take-up roller R3. The take-up roller R3 comprises an actuator for rotating the roll R3 and pulling on the web 3, such that the web 3 is under tension along the entire transport path P, or at least between the inkjet printing assembly 10 and the take-up roller R3.

Figure 3:
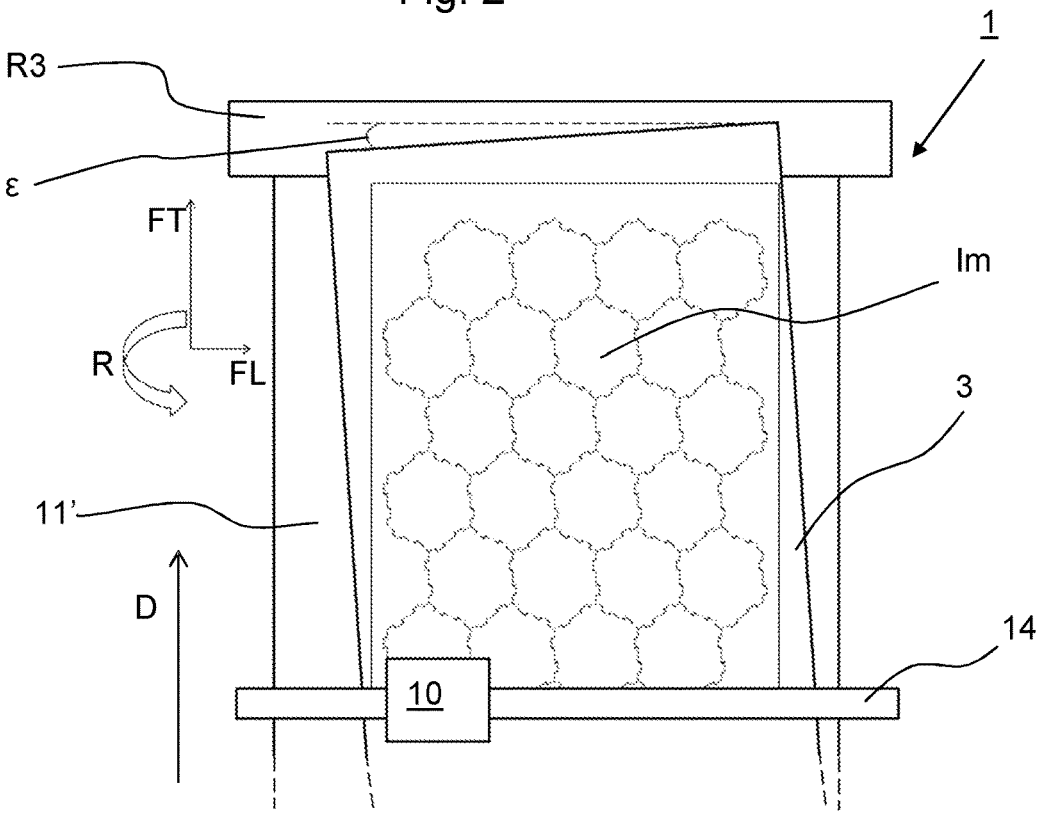
FIG. 3 is a schematic top view of a web between the inkjet printing assembly and the take-up roller in a printing system 1 according to the present invention.

Prior to printing the leading edge of the web 3 is attached to the take-up roller R3, as shown in FIG. 3. Attaching may be performed by the operator or an automated attachment unit. The web 3 is in practice never perfectly aligned with the rotation axis of the take-up roller R3. The leading edge of the web 3 is generally at a small angle ε with respect to the axis of the take-up roller R3, which angle ε is strongly exaggerated in FIG. 3 for the sake of illustration. While printing, the take-up roller R3 pulls on the web 3 to move the web 3 in the transport direction D. Due to the misalignment of the web 3 on the roller R3, the roller 3 exerts on the web 3 not only a force FD in the transport direction D but also a lateral force FL pushing the web 3 to a side of the transport path P and of the platen 11'. This interplay of forces FD, FL results in a rotation R of the web 3. This rotation R affects the image Im printed on the web medium 3, which becomes misaligned on the medium 3. Additionally the print quality is reduced, since the consecutive swaths wherein the image Im is printed do not properly overlap. Further, the web 3 may oscillate laterally, moving continuously from left to right in the width direction of the transport path P. Severe shifting or oscillating of the web 3 results in damaged media or a paper jam, as the medium 3 moves outside the transport path P. Rotation R is more likely to occur when applying high transport speeds, since both the speed of the web 3 and the forces FD, FL acting on it then become relatively large.

The present invention allows for high speed printing without additional effort to the operator by monitoring for the occurrence of the above described rotational effects and automatically taking appropriate action. Thereto, the printing system 1 comprises a sensor 20, 30 for detecting the tilting of the curved surface of the buffer plate 31.

In a preferred embodiment, the orientation sensor 30 comprises a curved buffer plate 31, as shown in FIG. 2. The buffer plate 31 is urged against the web 3 by one or more urging elements 33, which for example may be spring elements or actuators such as electrical linear motors. The urging elements 33 provide a controllable tension to the web 3, which tension may be adjusted by controlling the force applied by the urging elements 33 or the by controlling the position of the buffer plate 31. The orientation sensor 30 is further provided with a tilting sensor 32 for determining the orientation of the buffer plate 31. The tilting sensor 32 comprises one or more displacement or position sensors 32 to determine the relative position of one or both lateral sides of the buffer plate 31. During operation, the buffer plate 31 tilts around titling axis TA out of its initial or reference orientation OR. From the out-of-plane displacement of the side edges of the buffer plate 31, the tilting of the buffer plate 31 is determined. This provides an effective measure for the lateral tension distribution in the web and the rotation R of the web 3.

Figure 4A:
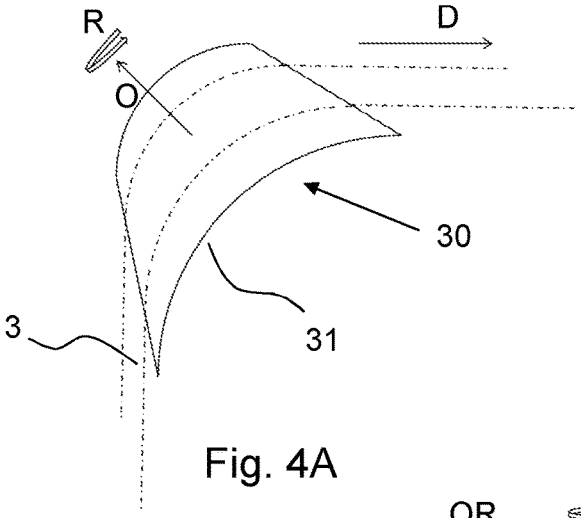
FIG. 4A-B are schematic perspective views of a buffer plate of a printing system according to the present invention in an aligned state (FIG. 4A) and a misaligned state of the web (FIG. 4B)
Figure 4B:
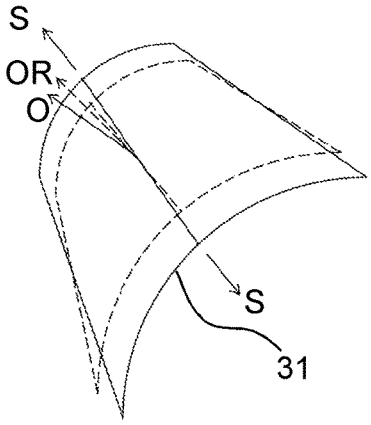

FIG. 4A explains in more details the workings of the tilting sensor 30. The tensioned web 3 runs over the curved buffer plate 31 in the transport direction D. Due to the misalignment of the web 3 on the roller R3, as shown in FIG. 3, the web 3 may rotate around a rotation axis parallel an out-of-plane direction O of the web 3. The out-of-plane direction O of the web 3 on the buffer plate 31 is equal to the out-of-plane orientation O of the buffer plate 31 since the web 3 is pre-tensioned over the buffer plate 31. A rotation R of the web 3 is due to the fact that the tension forces acting on one lateral side of the web 3 do not balance out the forces on the other side of the web 3. This results in a tilting S of the buffer plate 31 around a tilting axis TA parallel to the transport direction D. In FIG. 4B, the forces acting on the right side (when viewed along the transport direction) of the web 3 exceed those on the left side of the web 3. The right side of the buffer plate 31 is then pulled downwards i.e. in the out-of-plane direction of the transport path P. For the sake of illustration, the left side of the buffer plate 31 is shown to move upwards, though in practice both sides may also move downwards by different displacements Δ1, Δ2. The tilting S re-orients the buffer plate 32 from its reference orientation OR to the titled orientation O. In the reference orientation OR the out-of-plane direction O of the buffer plate is parallel to the out-of-plane direction (the normal) of the plane of the transport path P, the transport path P being defined as the path formed by the web 3 when aligned perfectly on the take-up roller R3.

Figure 4C:
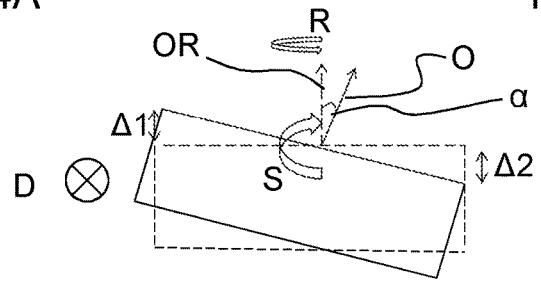
FIG. 4C is a schematic cross-sectional view of a buffer plate of a printing system according to the present invention.

The tilting of the buffer plate 32 is cross-sectionally shown in FIG. 4C. The buffer plate 31 tilts or rotates around the tilting axis TA locally parallel to the transport direction D and tangential to the support surface of the buffer plate 31. The lateral forces on the web 3 move the right side of the buffer plate 31 downwards by a displacement Δ1, while the left side moves up by a distance Δ2, which displacements Δ1, Δ2 are measured by the displacement sensors 32. From said displacements Δ1, Δ2 the orientation O of the buffer plate 31 with respect to the plane of the "ideal" transport path P may be determined. The tilting S of the buffer plate 31 may be defined by the tilting angle α between the sensed orientation (out-of-plane direction O) and the reference orientation of the buffer plate 31 (out-of-plane reference direction OR). The tilting S provides an accurate measure for the tension in the web 3 and for the rotation R of the web 3 with respect to the transport direction D. The rotation R of the web 3 can thus be derived from the tilting of the buffer plate 31 around the tilting axis TA, which tilting axis TA extends parallel to the transport direction whereas the rotation axis for the rotation R is perpendicular to transport direction (and to the plane of transport path P).

It will be appreciated that in an alternate embodiment, the tilting sensor 20 may be in the form of an optical camera system 20 to determine the orientation of the buffer plate 31.

The controller 40 compares the difference between the sensed orientation O and the reference orientation OR to a deviation threshold. Said threshold defines a distinction between errors which do affect image quality (visible artifacts) and invisible ones do not reduce print quality. The threshold is preferably a value for a threshold angle or a lateral shift threshold. Orientation errors below the threshold are so small that these do not show up in the printed image, at least not visible by eye. Since such negligible deviations do not visually affect print quality, these are preferably not corrected. This reduces the amount of operations performed by the printing system 1 and ensures smooth operation. Orientation errors above the threshold require compensating or correcting to prevent the image Im from becoming disturbed. In either case, during operation, the printing system 1 keeps monitoring the orientation O of the web 3.

Figure 5:
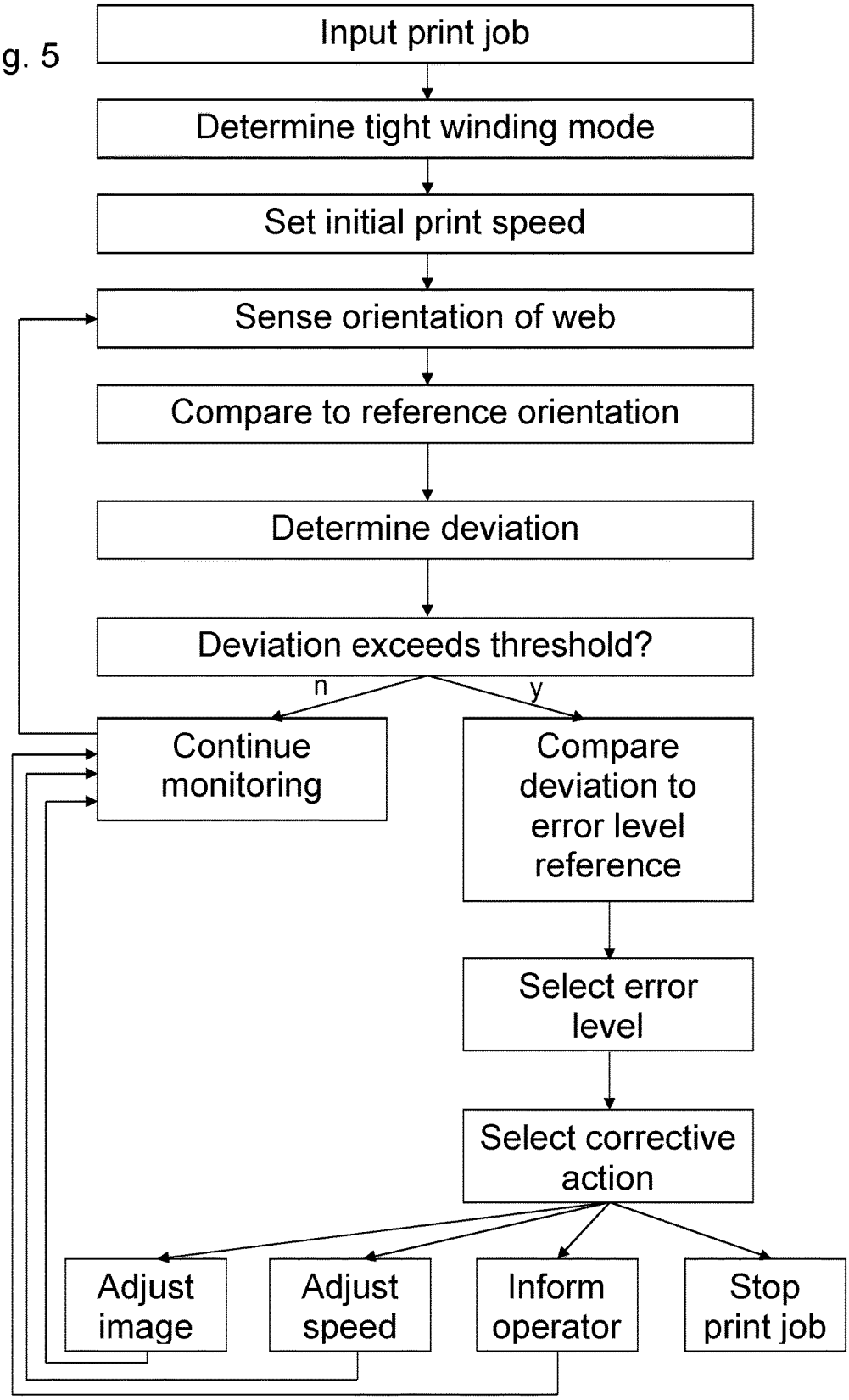
FIG. 5 is a diagram illustrating the method according to the present invention.

Once substantial tilting S and in consequence rotation R of the web 3 above the deviation threshold have been determined, the controller 40 initiates the appropriate corrective action, which is shown in the method diagram in FIG. 5. The method according to the present invention starts by an operator inputting a print job via a user interface 8 to the printing system 1. The print job is received by the controller 40, which configures the printing system 1 to perform the print job according to the parameters provided in the print job. When the controller 40 determines that the print job, or specifically the medium 3 used, requires tight winding, the printing system 1 is configured for tight winding, such that a pulling force or a longitudinal tension is present in the web 3, at least between the print heads 12*a-d* and the take-up roller R3. The controller 40 then sets the initial transport speed of the web 3 to 'high speed'. This allows the printing system 1 to start printing at least its normal production speed or even higher to prevent an initial reduction in productivity.

While printing the sensor 30 determines the orientation of the buffer plate 31. This sensed orientation O is compared to a reference orientation OR of the web 3 or the buffer plate 31, wherefrom a deviation or tilting angle α. Since deviations a may occur which are so small that these do not significantly affect the image quality, the deviation α is compared to a threshold. The threshold may be an upper limit, for example a maximum value for an orientation angle α or a lateral shift. The upper limits defines which deviations a are allowable without requiring correction by the printing system 1. i.e. which do not show up in the printed image. If the detected deviation α in the buffer plate's orientation O is below the threshold, printing is continued at the initially selected high speed and the orientation O of the web 3 is continually monitored by the sensor 30. Further, from this tilting angle α, the rotation of the web 3 with respect to the transport direction D can be derived. Said rotation may be further used to determine the amount of deviation in the web's position.

In case the controller 40 determines a significantly large deviation α of the web's orientation O with respect to its desired position OR on the transport path P, the controller 40 determines that the deviation α exceeds the predefined threshold. The appropriate error level for the deviation α is then determined by the controller 40. Thereby the controller 40 classifies the deviation α into one of a plurality of error levels, such as minor, medium, and critical deviations. This is done by comparing the deviation, for example the size or magnitude of the deviation angle, or the magnitude and frequency of the oscillations in the web's orientation, to an error level reference stored in the memory of the controller 40. The error level reference comprises criteria for classifying a deviation into an error level, for example by defining bottom and/or upper limits or ranges for matching the determined deviations to one of the error levels.

When a deviation has been selected or classified by the controller 40 as a specific class of error level, the controller 40 instructs the printing system 1 to perform one or more actions linked to said error level. The memory of the controller 40 stores for each error level instructions for performing corrective actions. The error level determines the corrective action(s) to be taken. For example, for minor deviations, the image to be printed may be repositioned or adjusted, either by adjusting the digital bitmap or by repositioning the print heads 12*a-d* to correct for the determined deviation of the web 3. When the determined deviations are too large to be corrected by adjusting the image, these deviations are classified into a different class. A different corrective action is also required. When selecting a class of such deviations of the web 3, especially in the case of determined periodic oscillations in the web's orientation O, the controller 40 adjusts the transport speed. The speed may be set to a predefined speed wherein oscillations of the web 3 were known to be minimal or absent. Alternatively the speed may be adjusted stepwise while continuously monitoring the deviation α of the web 3 to stepwise reduce or eliminate the deviations or oscillations in the web's orientation. Very large deviations which may cause damaged media or paper jams are classified as critical deviations. When this latter class is selected the controller 40 instructs the printing system 1 to halt the print operation, stopping both the transport mechanism R1-R3 and the inkjet printing assembly 10. Further, the controller 40 may, when selecting any of the error levels, instruct a communication device to send a signal to an operator. The communication device may be a light on the printer, a user interface for prompting the user, or an emitter for sending a wireless signal to a receiver held by the operator. The communication signal may be used to inform the operator of the status of the printing system 1 or to instruct the operator to attend the printing system 1, for example when an increase in deviations or certain class of deviations has been determined. This allows the operator to leave the system 1 unattended. It will be appreciated that apart from magnitude deviations in the web's positions may be classified by type, such as periodic oscillations, lateral shifts, rotations etc.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. Printing system for printing web media, comprising:

a take-out roller;

a take-up roller for pulling a web medium along a media transport path from the take-out roller to the take-up roller;

an image forming unit positioned along the media transport path, characterized by:

an orientation sensor for sensing an orientation of the web medium, the orientation sensor comprising:

a curved medium support surface defining a turn in the media transport path, which curved medium support surface is tiltable around a tilting axis, which tilting axis extends in a transport direction substantially tangentially to the curved medium support surface in a reference orientation;

a tilting sensor for determining tilting data proportional to a tilting angle by which the curved medium support surface is tilted from its reference orientation around the tilting axis;

a controller configured to:

receive the tilting data from the orientation sensor;

compare the tilting data to the reference orientation to determine an orientation error; and compare the orientation error to a deviation threshold.

2. Printing system according to claim 1, wherein:

the tilting sensor comprises a displacement sensor attached to the curved medium support surface for detecting a displacement of a section of the curved medium support surface in a direction substantially perpendicular to the curved medium support surface; and the controller is configured to compare the detected displacement to the reference orientation to determine the tilting data.

3. Printing system according to claim 2, wherein:

the tilting sensor comprises a pair of displacement sensors attached to opposing lateral sides of the curved medium support surface, each displacement sensor configured for detecting a displacement of a respective side of the curved medium support surface in a direction substantially perpendicular to the curved medium support surface; and the controller is configured to compare the detected displacements to one another to determine the tilting data.

4. Printing system according to claim 1, wherein the controller is further configured to emit an error signal for initiating an appropriate action of the printing system if the orientation error exceeds the deviation threshold.

5. Printing system according to claim 1, wherein the curved medium support surface is positioned upstream of the image forming unit.

6. Printing system according to claim 1, wherein the error signal is configured for reducing the transport speed of the web medium on the transport path.

7. Printing system according to claim 1, wherein the error signal is configured for initiating at least one of the following:

controlling the image forming unit to adjust a print job for an image to be printed on the web medium; and emitting a communication signal prompt to an operator.

8. Printing system according to claim 1, wherein the controller is arranged for:

classifying the orientation error into an error level by comparing the orientation error to an error level reference; and selecting one of the following steps determined by the error level:

controlling the image forming unit to adjust a print job for an image to be printed on the web medium;

reducing the transport speed;

emitting an communication signal prompt to an operator; and stopping the image forming unit, take-out roller, and the take-up roller.

9. Printing system according to claim 1, further comprising a buffer plate defining the curved medium support surface and urging elements for urging the buffer plate against the web medium, wherein the orientation sensor comprises a tilting angle sensor for determining an tilting angle around the tilting axis between the buffer plate and a buffer plate reference orientation.

10. Method for printing of web-based media, the method comprising the steps of:

pulling a web medium at a predefined transport speed over a media transport path, which media transport path extends along an orientation sensor comprising a curved medium support surface defining a turn in the media transport path and along an image forming unit to a pulling transport mechanism;

sensing the tilting of the curved medium support surface around a tilting axis, which tilting axis extends in a transport direction substantially tangential to the curved medium support surface in a reference orientation;

comparing the sensed tilting to the reference orientation to determine an orientation error; and comparing the orientation error to a deviation threshold.

11. Method according to claim 10, further comprising the step of:

sensing a displacement of a section of the curved medium support surface in a direction substantially perpendicular to the curved medium support surface; and determining the tilting of the curved medium support surface around a tilting axis from said displacement.

12. Method according to claim 10, further comprising the step of:

sensing a displacement of a two opposing lateral sides of the curved medium support surface in a direction substantially perpendicular to the curved medium support surface; and determining the tilting of the curved medium support surface around a tilting axis from said displacements.

13. Method according to claim 10, further comprising the step of emitting an error signal if orientation error exceeds the deviation threshold.

14. Method according to claim 13, further comprising at least one of the following steps:

adjusting a print job for an image to be printed on the web medium;

adjusting the transport speed;

emitting a communication signal; and stopping transport of the web medium.

15. Method according to claim 10, wherein the step of comparing the orientation data to a reference orientation further comprises determining a rotation angle parameter, which rotation angle parameter corresponds to an angle between a longitudinal direction of the web medium and a transport direction of the media transport path.

* * * * *